US006216887B1

(12) United States Patent
Soo

(10) Patent No.: US 6,216,887 B1
(45) Date of Patent: Apr. 17, 2001

(54) DETACHABLE HANGER FOR SPORT PADS

(76) Inventor: Mike Soo, No. 931, Chung Shan Road, Jen Teh Shiang, Tainan Hsien (TW)

( * ) Notice: Subject to any disclaimer, the term of this patent is extended or adjusted under 35 U.S.C. 154(b) by 0 days.

(21) Appl. No.: 09/440,228

(22) Filed: Nov. 15, 1999

(51) Int. Cl.[7] ..... A47F 5/00

(52) U.S. Cl. ..... 211/85.7; 211/205; 211/189; D6/552; 248/163.1; 248/188.7

(58) Field of Search ..... D6/552; 211/85.7, 211/205, 196, 189, 85.3; 248/159, 163.1, 188.7

(56) References Cited

U.S. PATENT DOCUMENTS

| | | | | |
|---|---|---|---|---|
| D. 394,926 | * | 6/1998 | Lendsay | D6/552 X |
| D. 398,469 | * | 9/1998 | Leong et al. | D6/552 |
| D. 406,960 | * | 3/1999 | Zaid | D6/552 X |
| 3,186,561 | * | 6/1965 | Strassle . | |
| 3,310,180 | * | 3/1967 | Neagle . | |
| 3,655,156 | * | 4/1972 | Petrie | 248/188.7 X |
| 3,719,340 | * | 3/1973 | Norton . | |
| 4,865,283 | * | 9/1989 | Parker | 211/205 X |
| 5,318,175 | * | 6/1994 | Stevens | 211/205 X |
| 5,377,849 | * | 1/1995 | Martin | 211/85.7 |
| 5,487,476 | * | 1/1996 | Barfield | 248/159 X |
| 5,862,924 | * | 1/1999 | Dumont | 211/85.7 |
| 6,073,783 | * | 6/2000 | Allman | 211/85.7 X |

* cited by examiner

*Primary Examiner*—Robert W. Gibson, Jr.
(74) *Attorney, Agent, or Firm*—Alan Kamrath; Rider Bennett Egan & Arundel, LLP.

(57) ABSTRACT

A detachable hanger for sport pads includes a base, a number of legs, a number of posts, a number of interconnecting blocks, and a number of hanger members. Each leg has an end releasably engaged with the base. The posts are detachably mounted to the base in an upright manner. The interconnecting blocks interconnect the posts in the upright manner. Each interconnecting block includes an inner flange to thereby define an upper positioning compartment for securely yet releasably receiving a lower end of one post located above the interconnecting block and a lower positioning compartment for securely yet releasably receiving an upper end of one post located below the interconnecting block. Each hanger member has an end releasably engaged with an associated interconnecting block.

12 Claims, 4 Drawing Sheets

DETACHABLE HANGER FOR SPORT PADS

BACKGROUND OF THE INVENTION

1. Field of the Invention

The present invention relates to a hanger for sport pads, and more particularly to a detachable hanger for easy transportation and for providing a convenient tool for hanging and displaying the sport pads.

2. Description of the Related Art

Sport pads, e.g., helmets, chest pads, elbow pads, and kneepads, are important in violent games, as they may prevent injury to the players' bodies when the players are subjected to to impact and thus fall. Maintenance and cleaning of sport pads are also important. The sport pads are inevitably wetted in sweat and will stink and provide a bed for germs if they are immediately put into closets after use. Some users hang their sport pads on an ordinary hanger for drying. Yet, such hanger is not detachable and thus inconvenient to carry.

The present invention is intended to provide a detachable hanger that mitigates and/or obviates the above problem.

SUMMARY OF THE INVENTION

It is a primary object of the present invention to provide a hanger for sport pads that can is be detached for easy carriage.

It is another object of the present invention to provide a hanger that may be used for displaying the sport pads hung thereon.

A detachable hanger for sport pads in accordance with the present invention comprises:

a base;

a plurality of legs each having an end releasably engaged with the base;

a plurality of posts detachably mounted to the base and located in an upright manner;

a plurality of interconnecting blocks for interconnecting the posts in the upright manner, each said interconnecting block including an inner flange to thereby define an upper positioning component for securely yet releasably receiving a lower end of one said plurality of post located above the interconnecting block and a lower positioning compartment for securely yet releasably receiving an upper end of one said plurality of posts located below the interconnecting block; and at least one hanger member each having an end releasably engaged with each said interconnecting block The base includes a plurality of sides each having an engaging groove, and the end of each leg includes an engaging member releasably engaged with an associated engaging groove of the base. The engaging grooves of the base and the engaging members of the legs may be T-shape.

Each leg further includes a notch in a mediate portion thereof An auxiliary connecting rod is connected between each two adjacent legs. The auxiliary connecting rod includes two ends each of which is releasably engaged in an associated notch.

The base includes a central positioning groove for releasably engaging with a lower end of a lowermost one of the posts.

Each interconnecting block includes an engaging groove in at least one side thereof and the hanger member includes an inner end with an engaging member releasably engaged with said engaging groove. The engaging groove and the engaging member may be T-shape. The hanger member may include a second hooked end. The hanger member may further include at least one hole for releasably attaching a hook.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
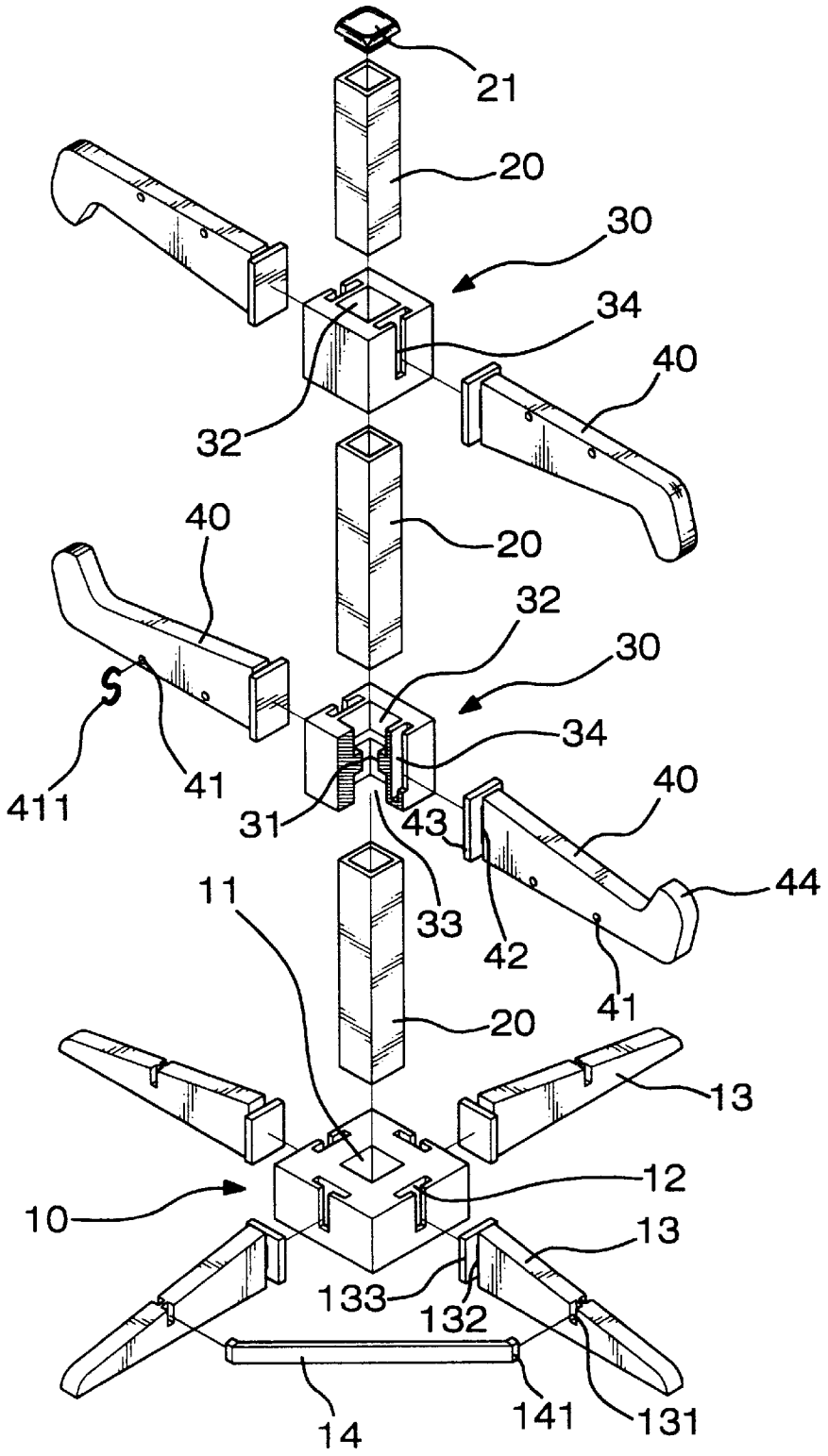
FIG. 1 is an exploded perspective view of a detachable hanger in accordance with the present invention.
Figure 2:
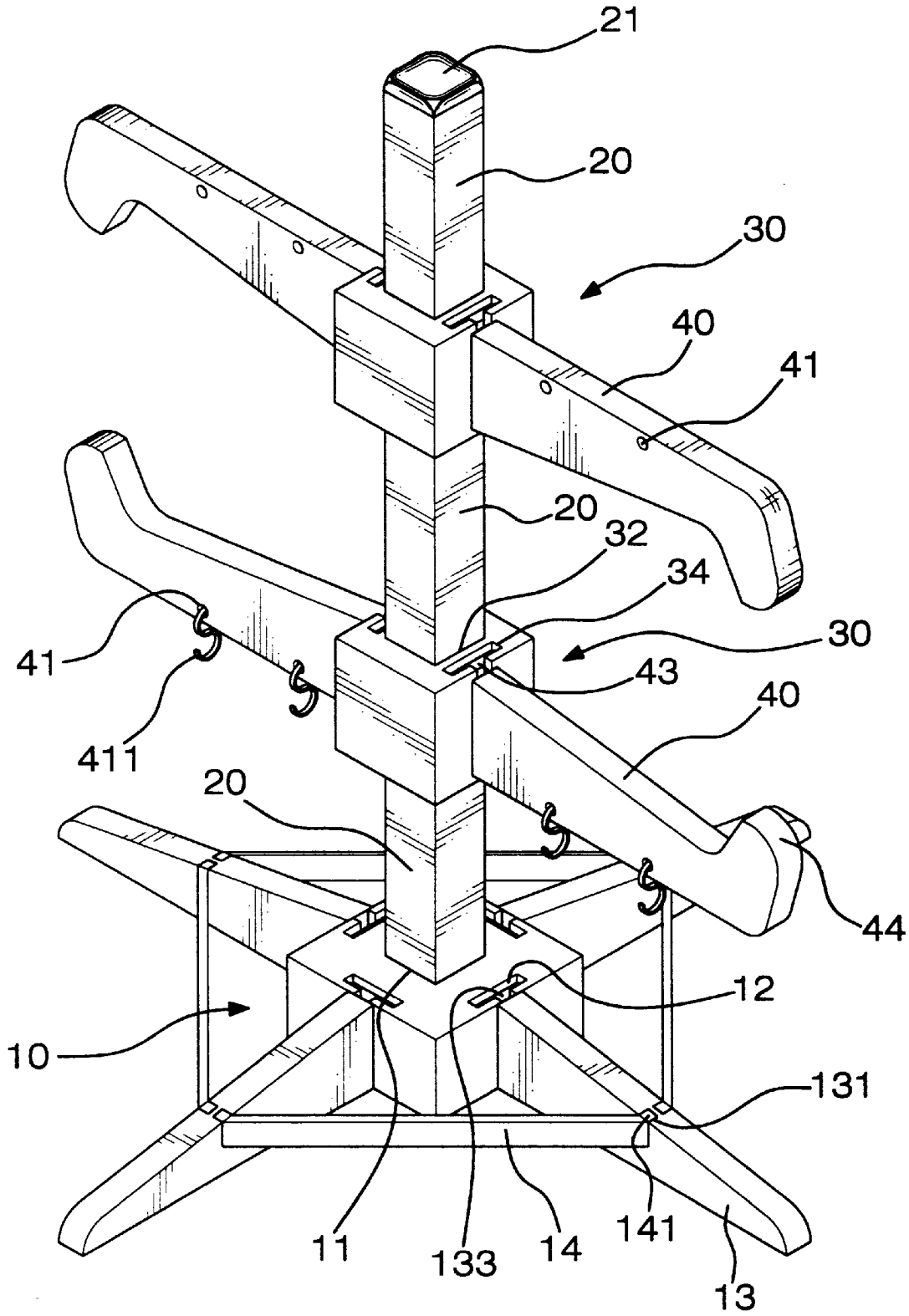
FIG. 2 is a perspective view of the detachable hanger in accordance with the present invention.
Figure 3:
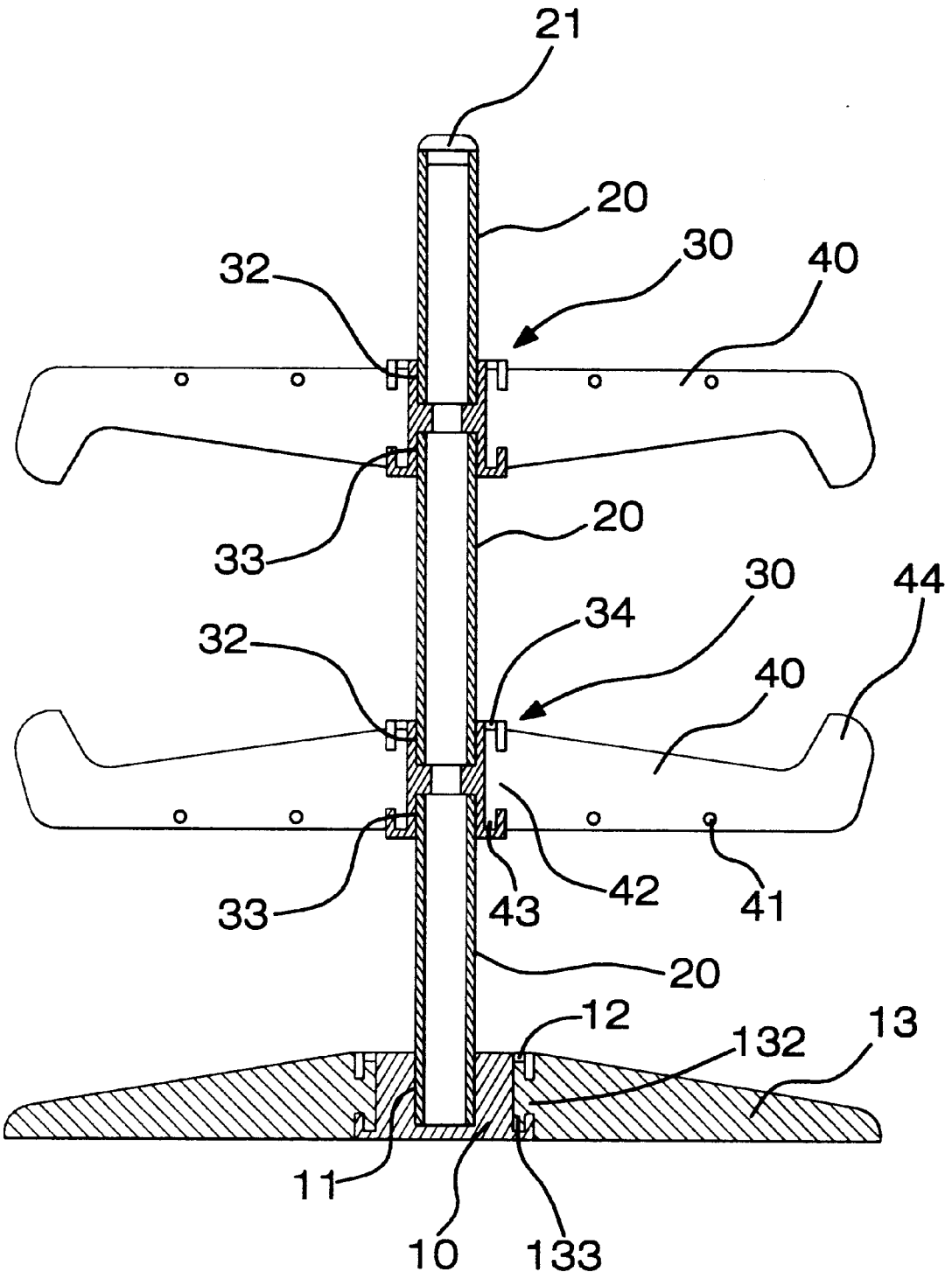
FIG. 3 is a schematic sectional view of the detachable hanger in accordance with the present invention.

Referring to FIGS. 1 through 4 and initially to FIGS. 1 through 3, a detachable hanger in accordance with the present invention generally includes a base 10, a number of legs 13, a number of posts 20, a number of interconnecting blocks 30, and a number of hanger members 40.

The base 10 includes a central positioning hole or groove 11 for releasably engaging with a lower end of one of the posts 20. The base 10 further includes a T-shape engaging groove 12 in each of four sides thereof Each leg 13 includes an end 132 with a T-shape engaging member 133 releasably engaged with an associated engaging groove 12. Each leg 13 further includes a notch 131 in a mediate portion thereof At least one auxiliary connecting rod 14 may be connected between each two adjacent legs 13. Each end 141 of the auxiliary connecting rod 14 is releasably engaged in an associated notch 131, thereby providing a stable base.

Each interconnecting block 30 is substantially tubular and includes an inner flange 31 to thereby define an upper positioning compartment 32 for securely yet releasably receiving a lower end of one post 20 located above the interconnecting block 30 and a lower positioning compartment 33 for securely yet releasably receiving an upper end of one post 20 located below the interconnecting block 30. At least one side of each interconnecting block 30 includes a T-shape engaging groove 34. Each hanger member 40 includes an inner end 42 with a T-shape engaging member 43 releasably engaged with an associated engaging groove 34 and an outer hooked end 44. Each hanger member 40 may further include a number of holes 41 for releasably attaching hooks 411. An upper cap 21 may be engaged on the upper end of the uppermost post 20.

Figure 4:
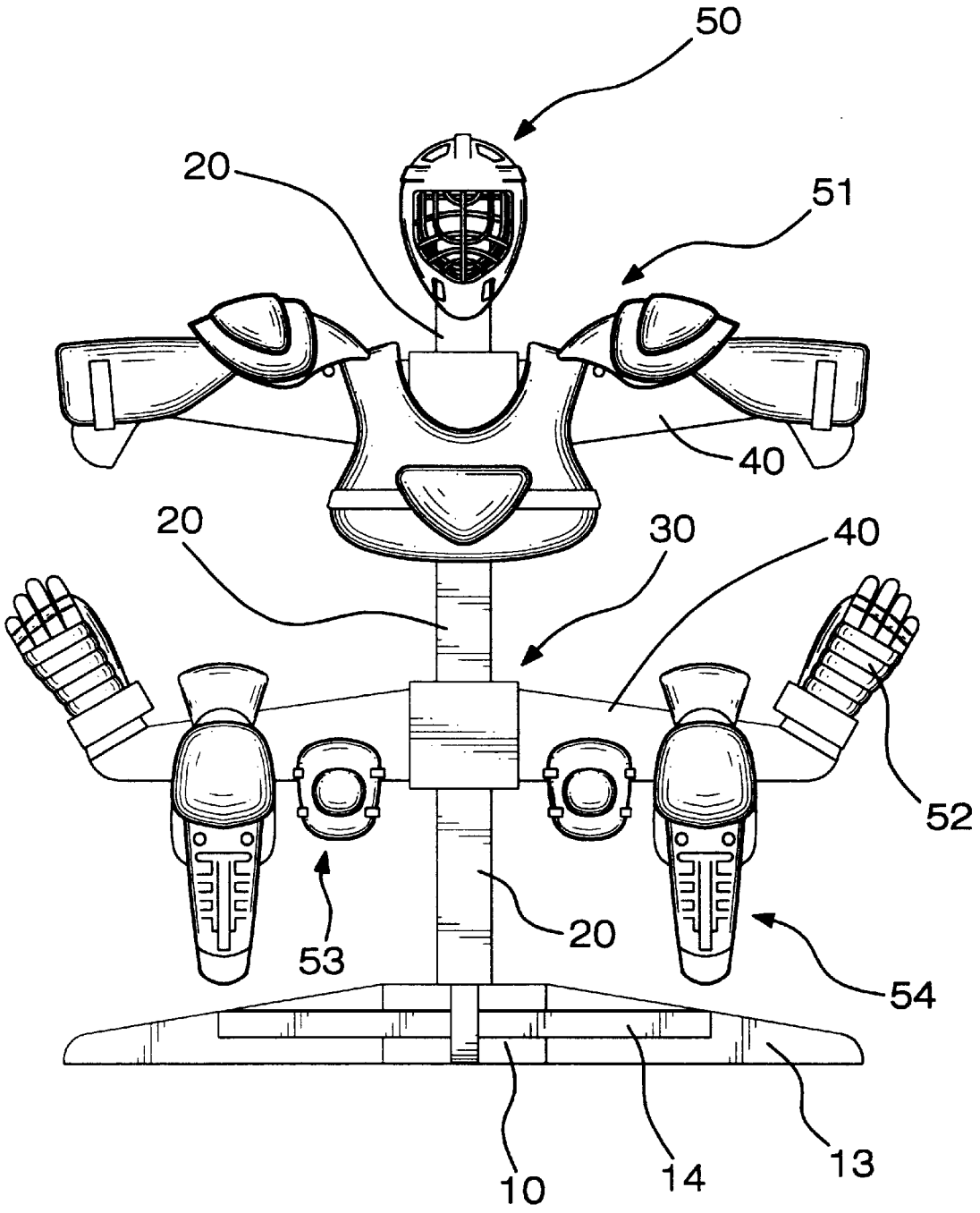
FIG. 4 is a perspective view illustrating use of the detachable hanger in accordance with the present invention.

Referring to FIGS. 1 through 4, the hanger can be easily and conveniently assembled and detached without using any tool. In addition, the hanger may be assembled to a desired level. As illustrated in FIG. 4, a helmet 50, a body pad 51, gloves 52, knee pads 53, and elbow pads 54 may be hung up to the hanger. The whole set of a sport padding device (including a helmet 50, a body pad 51, two gloves 52, two knee pads 53, and two elbow pads 54) may be hung up to the hanger for drying purposes under sanitary consideration. In addition, the whole set of the padding device may be hung in an aesthetically pleasing manner to provide a displaying function The hanger can be detached and carried by the user, which is extremely convenient to a user that plays games at different places.

Although the invention has been explained in relation to its preferred embodiment, it is to be understood that many other possible modifications and variations can be made without departing from the spirit and scope of the invention as hereinafter claimed.

What is claimed is:

1. A detachable hanger for sport pads, comprising:

a base;

a plurality of legs each having an end releasably engaged with the base;

a plurality of posts detachably mounted to the base and located in an upright manner;

a plurality of interconnecting blocks for interconnecting the posts in the upright manner, each said interconnecting block including an upper positioning compartment for securely yet releasably receiving a lower end of one said post located above the interconnecting block and a lower positioning compartment for securely yet releasably receiving an upper end of one said post located below the interconnecting block; and at least one hanger member, said at least one hanger member having an end releasably engaged with a said interconnecting block;

wherein the base includes a plurality of sides each having an engaging groove, the end of each said leg including an engaging member releasably engaged with an associated said engaging groove of the base.

2. The detachable hanger as claimed in claim 1, wherein the engaging grooves of the base and the engaging members of the legs are T-shape.

3. A detachable hanger for sport pads, comprising:

a base;

a plurality of legs each having an end releasable engaged with the base and a notch in a mediate portion thereof;

a plurality of posts detachably mounted to the base and located in an upright manner;

a plurality of interconnecting blocks for interconnecting the posts in the upright manner, each said interconnecting block including an upper positioning compartment for securely yet releasably receiving a lower end of one said post located above the interconnecting block and a lower positioning compartment for securely vet releasably receiving an upper end of one said post located below the interconnecting block;

at least one hanger member, said at least one hanger member having an end releasably engaged with a said interconnecting block; and at least one auxiliary connecting rod connected between each two adjacent said legs, said at least one auxiliary connecting rod including two ends each of which is releasably engaged in an associated said notch.

4. The detachable hanger as claimed in claim 2, wherein the base includes a central positioning groove for releasably engaging with a lower end of a lowermost one of the posts.

5. A detachable hanger for sport pads comprising;

a base;

a plurality of legs each having an end releasably engaged with the base;

a plurality of posts detachably mounted to the base and located in an upright manner;

a plurality of interconnecting blocks for interconnecting the posts in the unright manner, each said interconnecting block including an upper positioning compartment for securely yet releasably receiving a lower end of one said post located above the interconnecting block and a lower positioning compartment for securely yet releasably receiving an upper end of one said post located below the interconnecting block; and at least one hanger member, said at least one hanger member having an end releasable engaged with a said interconnecting block;

wherein each said interconnecting block includes an engaging groove in at least one side thereof, and said at least one hanger member includes an inner end with an engaging member releasably engaged with said engaging groove.

6. The detachable hanger as claimed in claim 5, wherein the engaging groove and the engaging member are T-shape.

7. The detachable hanger as claimed in claim 5, wherein said at least one hanger member includes a second hooked end.

8. The detachable hanger as claimed in claim 1, wherein said at least one hanger member includes at least one hole for releasably attaching a hook.

9. The detachable hanger as claimed in claim 3, wherein said at least one hanger member includes at least one hole for releasably attaching a hook.

10. The detachable hanger as claimed in claim 5, wherein said at least one hanger member includes at least one hole for releasably attaching a hook.

11. The detachable hanger as claimed in claim 3, wherein the base includes a central positioning groove for releasably engaging with a lower end of a lowermost one of the posts.

12. The detachable hanger as claimed in claim 5, wherein the base includes a central positioning groove for releasably engaging with a lower end of a lowermost one of the posts.

* * * * *